US009123491B2

(12) United States Patent
Yang

(10) Patent No.: US 9,123,491 B2
(45) Date of Patent: Sep. 1, 2015

(54) GAS INSULATED SWITCHGEAR

(71) Applicant: LSIS CO., LTD., Anyang-si, Gyeonggi-do (KR)

(72) Inventor: Jae Min Yang, Daejeon (KR)

(73) Assignee: LSIS CO., LTD., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/133,176

(22) Filed: Dec. 18, 2013

(65) Prior Publication Data

US 2014/0190939 A1 Jul. 10, 2014

(30) Foreign Application Priority Data

Jan. 8, 2013 (KR) ..... 10-2013-0002233

(51) Int. Cl.
*H01H 33/42* (2006.01)
*H01H 33/91* (2006.01)
*H01H 3/42* (2006.01)

(52) U.S. Cl.
CPC ..... *H01H 33/91* (2013.01); *H01H 3/42* (2013.01); *H01H 33/42* (2013.01)

(58) Field of Classification Search
CPC ..... H01H 33/42; H01H 3/42; H01H 3/46; H01H 3/3015; H01H 1/50
USPC ..... 335/16, 172, 195; 218/43, 84, 140, 117, 218/149
See application file for complete search history.

(56) References Cited

U.S. PATENT DOCUMENTS

| | | | | |
|---|---|---|---|---|
| 3,201,551 | A * | 8/1965 | Mercier | 218/23 |
| 3,729,606 | A * | 4/1973 | Bogert | 218/9 |
| 3,814,878 | A * | 6/1974 | Weston et al. | 218/7 |
| 6,034,586 | A * | 3/2000 | Runyan et al. | 335/172 |
| 7,772,513 | B2 * | 8/2010 | Ohda et al. | 200/400 |
| 8,420,969 | B2 * | 4/2013 | Marushima et al. | 200/400 |
| 2010/0126967 | A1 * | 5/2010 | Ohda et al. | 218/154 |
| 2012/0175228 | A1 | 7/2012 | Obata et al. | |

FOREIGN PATENT DOCUMENTS

| | | | | |
|---|---|---|---|---|
| DE | 4305512 | | 8/1994 | |
| EP | 1914772 | * | 4/2008 | H01H 3/30 |
| EP | 1631977 | * | 7/2008 | H01H 3/42 |
| JP | 2000260248 | | 9/2000 | |
| JP | 2011151990 | | 8/2011 | |

OTHER PUBLICATIONS

European Patent Office Application Serial No. 1319871.0, Extended Search Report dated Apr. 3, 2014, 10 pages.

* cited by examiner

*Primary Examiner* — Truc Nguyen
(74) *Attorney, Agent, or Firm* — Lee, Hong, Degerman, Kang & Waimey

(57) ABSTRACT

A gas insulated switchgear includes: an enclosure; a stationary contact arm fixedly installed within the enclosure; a movable contact arm installed to be moved within the enclosure such that it is brought into contact with or separated from the stationary contact arm; a cam reciprocating between closing and opening positions to move the movable contact arm; and an actuator moving the cam, wherein the cam includes first and second cam surfaces, and when the cam moves to an opening position by the actuator, movement acceleration of the movable contact arm by the first cam surface is greater than movement acceleration by the second cam surface and a movement distance of the movable contact arm by the first cam surface is smaller than a movement distance by the second cam surface.

13 Claims, 3 Drawing Sheets

GAS INSULATED SWITCHGEAR

CROSS-REFERENCE TO RELATED APPLICATION

Pursuant to 35 U.S.C. §119(a), this application claims the benefit of earlier filing date and right of priority to Korean Application No. 10-2013-0002233, filed on Jan. 8, 2013, the contents of which is incorporated by reference herein in its entirety.

BACKGROUND OF THE INVENTION

1. Field of the Invention

The present disclosure relates to a gas insulated switchgear, and particularly, to a switchgear devised to open or close an electric power transmission line and extinguish an arc generated in performing an insulating or breaking operation by using a gas.

2. Background of the Invention

In general, a switchgear refers to a device that opens or closes an electric load or breaks a current when an accident or a fault such as ground fault, short-circuit, or the like, in a transmission and substation (or transformation) system or in an electrical circuit. In particular a gas insulated switchgear includes a breaking part disposed in a tank-type enclosure charged with $SF_6$ insulating gas as a tasteless, odorless, non-toxic inert insulating gas having excellent insulating properties. In the gas insulated switchgear, an electrical line in use may be opened or closed manually or may be opened or closed by an actuator, or the like, installed outside of the enclosure remotely. In the event of an overload or short-circuit, the gas insulated switchgear automatically breaks a current to protect an electric power system and electric load devices.

As mentioned above, the gas insulated switchgear includes a stationary contact arm and a movable contact arm installed in a breaking part thereof. Normally, the stationary contact arm is in contact with the movable contact arm to allow a current to flow, and in a case in which a large current flows due to fault current on an electric power line, the movable contact arm and the stationary contact arm are separated quickly to break such a large current.

Here, the actuator moves a cylinder rod connected to a cylinder by actuating power generated from a spring, or the like, charged by hydraulic pressure, pneumatic pressure or a motor to a breaking position, and when insulating arc-extinguishing gas is compressed within a compression chamber according to the movement of the cylinder rod, the compressed arc-extinguishing gas having high pressure is jetted to an arc to cool and extinguish the arc to accomplish breaking the circuit. Thus, the breaking operation to break a fault current requires a high degree of actuating power, relative to a connection (in other words "closing") operation. In addition, in order to enhance breaking performance, the movable contact arm needs to be separated from the stationary contact arm as quickly as possible, and even after the separation of the movable contact arm, preferably, a distance between the movable contact arm and the stationary contact arm is maintained as large as possible.

Namely, at an initial stage of a breaking operation, the movable contact arm should overcome frictional force between the stationary contact arm and the movable contact arm and pressure of the arc-extinguishing gas to move, so resistance with respect to movement of the movable contact arm is increased, relative to a closing operation. In addition, in order to reduce a time during which a fault current flows as much as possible, the movable contact arm should be separated from the stationary contact arm at a very fast speed.

To this end, however, a large capacity actuator is required. In detail, in order to increase actuating power, a large capacity spring needs to be used, which, however, results in an increase in a volume of the actuator. In addition, in order to stably support the large capacity spring, strength of a structure fixedly supporting the spring needs to be increased, further increasing the volume of the actuator.

Thus, there is a need to quickly perform a breaking operation without greatly increasing the volume of the actuator, and U.S. Pat. No. 7,528,336 discloses an example. In the related art, high torque is allowed to be transmitted at an initial stage of a breaking operation by adjusting a configuration and a disposition angle of a link member connecting a lever of a actuator and a rod of a movable contact arm to thus quickly perform a breaking operation. In detail, in the related art, a breaking operation is quickly performed by applying maximum torque to the link member by actuating power at an initial stage of the breaking operation. In particular, in the related art, operational characteristics at the initial stage of the breaking operation are improved by making the use of the fact that a prompt operation is not necessary in case of a circuit closing operation, relative to the breaking operation.

However, even with the related art, a time during which maximum torque is transmitted is too short and the decrement of torque based on a movement of a movable contact arm is too large, so it is difficult to obtain a sufficient breaking speed. Namely, in order to perform a breaking operation with maximum acceleration force at the initiation of the breaking operation, maximum torque needs to last as long as possible or the decrement of torque needs to be small, but in the related art, it is impossible to adjust the duration or the decrement.

In addition, in order to maximize acceleration with which the movable contact arm is moved in a state in which the breaking operation is performed to a degree, the better a time interval during which maximum torque and minimum torque is applied is shorter, but with the related art, it is impossible to adjust the time interval.

SUMMARY OF THE INVENTION

Therefore, an aspect of the detailed description is to provide a gas insulated switchgear capable of obtaining a relatively fast breaking operation with the same actuating power.

Another aspect of the detailed description is to provide a gas insulated switchgear capable of easily adjusting movement characteristics of a movable contact arm.

To achieve these and other advantages and in accordance with the purpose of this disclosure, as embodied and broadly described herein, a gas insulated switchgear according to this disclosure comprises an enclosure; a stationary contact arm fixedly installed within the enclosure; a movable contact arm installed to be moved within the enclosure such that it is brought into contact with or separated from the stationary contact arm; a cam reciprocating between a closing position and an opening position to move the movable contact arm; and an actuator that moves the cam, wherein the cam comprises first and second cam surfaces, and when the cam moves to the opening position by the actuator, movement acceleration of the movable contact arm by the first cam surface is greater than movement acceleration by the second cam surface and a movement distance of the movable contact arm by the first cam surface is smaller than a movement distance by the second cam surface.

According to an aspect of the present disclosure, the movable contact arm is moved by the cam that reciprocates by the actuator. In particular, the cam may be configured to reciprocate between a closing position in which the movable contact arm and the stationary contact arm are in contact and an opening position in which the movable contact arm is separated from the stationary contact arm as far as possible, and in this process, the movable contact arm is moved according to a movement speed and distance determined according to shapes of the first and second cam surfaces provided in the cam. Thus, the first cam surface determines a movement of the movable contact arm at an initial stage of a breaking operation and the second cam surface determines a movement of the movable contact arm at a late stage of the breaking operation, the breaking operation of the movable contact arm can be easily set.

Also, since a movement speed and a movement distance of the movable contact arm by the first cam surface are higher and shorter than a movement speed and a movement distance thereof by the second cam surface, respectively, the movable contact arm can be quickly separated at the initial stage of the breaking operation, and at a late stage, the movable contact arm may be positioned to be separated at a long distance although a speed thereof is low.

Here, an average slope of the first cam surface with respect to an axial direction of the movable contact arm may be set to be greater than that of the second cam surface.

The cam may further include a third cam surface disposed between the first cam surface and the second cam surface, and an average slope of the third cam surface may have a value between average slopes of the first and second cams. Also, a recess may be provided on an end portion of the second cam surface to prevent the movable contact arm separated according to a breaking operation from moving toward the stationary contact arm.

Meanwhile, the cam may include a space portion provided therein, and the first and second cam surfaces may be provided on an inner circumferential surface of the space portion.

Here, the gas insulated switchgear may further include a cam housing accommodating the cam therein and having a guide bar that guides a movement of the cam.

A guide rail may be provided within the cam housing to guide a movement of the movable contact arm.

The gas insulated switchgear may further including an insulating rod connected to the movable contact arm and the cam.

Also, at least a portion of the insulating rod may be inserted into the between the guide rails.

Also, a cam roller in contact with the cam surface may be installed at an end portion of the insulating rod.

Also, both end portions of a rotational shaft supporting the cam roller may be inserted into the between the guide rails.

The actuator may include an operating lever reciprocating within a predetermined angle range, and may further include a connection rod that connects the operating lever and the cam. A long hole may be formed in an end portion of the connection rod, and the connection rod and the operating lever may be hinge-coupled through the long hole.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a gas insulated switchgear according to an exemplary embodiment of the present invention will be described in detail with reference to the accompanying drawings.

Figure 1:
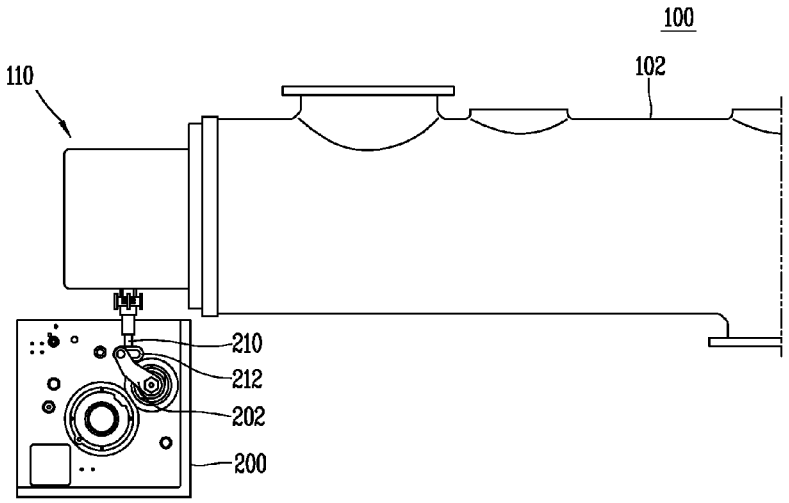
FIG. 1 is a side view schematically illustrating a portion of the exterior of a gas insulated switchgear according to an exemplary embodiment of the present invention.

FIG. 1 is a side view schematically illustrating a portion of the exterior of a gas insulated switchgear according to an exemplary embodiment of the present invention. Referring to FIG. 1, a gas insulated switchgear 100 according to the exemplary embodiment of the present invention includes an enclosure 102 having a substantially cylindrical shape. The interior of the enclosure 102 is charged with a sulfur hexafluoride (abbreviated as $SF_6$ hereinafter) insulating gas, a tasteless, odorless, nontoxic inert insulating gas, as an arc-extinguishing gas, and a terminal bushing (not shown) may be provided to be connected to an electric power system.

Meanwhile, a cam housing 110 accommodating a cam (to be described) is provided on one side of the enclosure 102. The cam housing 110 has a cylindrical shape having a diameter similar to that of the enclosure 102, and one end portion thereof is open to communicate with an internal space of the enclosure 102.

Meanwhile, a actuator 200 is disposed below the cam housing 110. An operating lever 202 for transmitting actuating power generated by the actuator 200 to the outside is installed on one side of the actuator 200. The operating lever 202 is configured to rotate in a clockwise or counterclockwise direction by torque generated by an electric motor and a spring provided within the actuator 200, and a connection rod 210 is hinge-coupled to an end portion thereof.

The connection rod 210 has a connection hole (a long hole) 212 formed in one end portion thereof, and the operating lever 202 and the connection rod 210 are hinge-coupled through the connection hole 212. Thus, although the operating lever 202 rotates, a hinge shaft (not shown), moving within the long hole (that is connection hole 212) of the connection rod 210, smoothly transforms a rotational movement of the operating lever 202 into a sliding movement of the connection rod 210.

Figure 2:
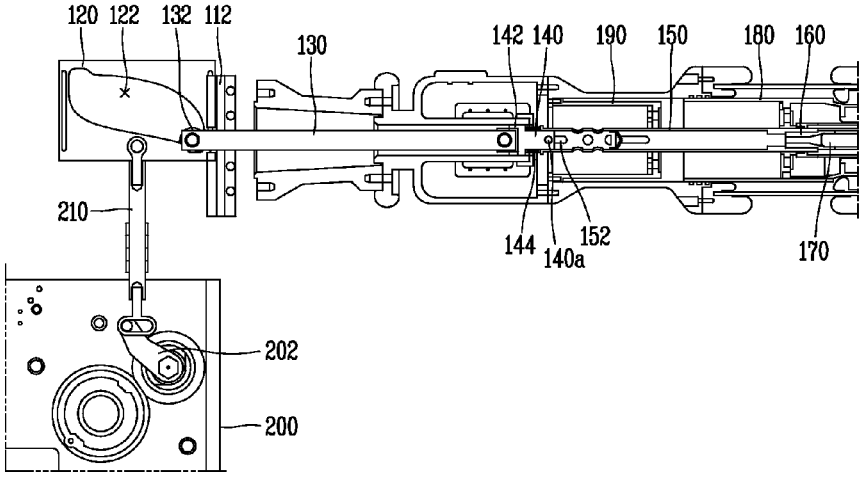
FIG. 2 is a cross-sectional view illustrating a state in which a movable contact arm is in a closing position in the gas insulated switchgear according to the embodiment of the present invention.

FIG. 2 is a cross-sectional view illustrating an internal structure of the gas insulated switchgear according to the exemplary embodiment of the present invention. In FIG. 2, the enclosure and the cam housing are omitted to help understanding. As mentioned above, the cam 120 is accommodated within the cam housing 110. The cam 120 is hinge-coupled with an upper end portion (based on FIG. 2) of the connection rod 210, so that when the operating lever 202 rotates, the cam 120 is moved upwards or downwards by the connection rod 210.

In this case, in order to allow the cam 120 to be smoothly moved, a guide bar 112 engaged with one side of the cam 120 to guide a vertical movement of the cam 120 is installed within the cam housing 110. A groove (not shown) extending up and down is provided in the guide bar 12, and one side of the cam 120 is inserted into the interior of the groove, whereby a vertical movement of the cam 120 is guided.

Figure 3:
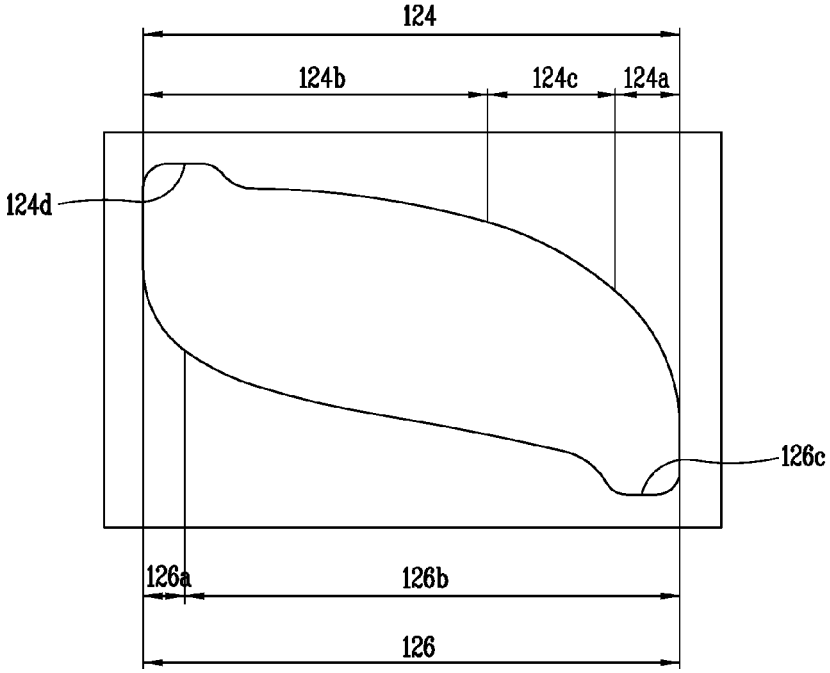
FIG. 3 is a front view illustrating cam in the gas insulated switchgear according to the embodiment of the present invention.

Meanwhile, a space portion 122 is provided within the cam 120, and a cam surface is provided along an inner circumferential surface of the space portion 122. FIG. 3 is an enlarged front view of the space portion 122 of the cam 120. The cam surface includes an opening cam surface 124 allowing a movable contact arm to become distant from a stationary contact arm and a closing cam surface 126 allowing the movable contact arm to be moved toward the stationary contact arm, as described hereinafter.

The opening cam surface 124 is divided into first to third cam surfaces 124*a*, 124*b*, and 124*c*, and a recess (in other words a hooking and stopping portion) 124*d* is provided in an end portion of the second cam surface 124*b*. The closing cam surface 126 is divided into first and second cam surfaces 126*a* and 126*b*. Each of the cam surfaces will be described hereinafter.

Referring back to FIG. 2, the cam 120 is connected to an insulating rod 130. A roller 132 is installed at one end portion of the insulating rod 130. The roller 132 lands on the opening cam surface and the closing cam surface as described above to serve to reduce frictional force between the insulating rod 130 and the cam surfaces. Also, the insulating rod 130 is disposed to be parallel to a length direction of the enclosure 102, and the other end thereof is connected to an intermediate rod 140.

One end portion of the intermediate rod 140 is connected to the insulating rod 130 as mentioned above, and the other end thereof is connected to an end rod 150. The interior of the end rod 150 is hollow, and a movable contact arm 160 is installed at one end portion of the end rod 150. As illustrated, the interior of the movable contact arm 160 is hollow, and a stationary contact arm 170 is inserted into the empty space of the movable contact arm 160 while the outer circumferential wall of the stationary contact arm 170 contacts the inner circumferential wall of the movable contact arm 160 so as to be electrically connected with each other.

Here, a flange 142 is provided at one side of the intermediate rod 140, and a buffer spring 144 is installed in the flange 142. One end portion of the buffer spring 144 is in contact with an end portion of the end rod 150 to buffer impact applied during a breaking (in other words opening) and closing operation. The intermediate rod 140 is hinge-coupled with the end rod 150, and a hinge shaft 140*a* of the hinge is insertedly supported in a long hole 152 formed to extend in an axial direction at an end portion of the end rod 150. Accordingly, even in a state in which the insulating rod 130 and the intermediate rod 140 are fixed, the end rod 150 may move within a limited length of the long hole 152. In this case, however, due to elastic force of the buffer spring 144, the end rod 150 is maintained to be separated from the intermediate rod 140.

For example, when the insulating rod 130 moves leftwards (or to the left) on the basis of the FIG. 2 due to a breaking operation, the hinge shaft 140*a* of the intermediate rod 140 is maintained to be in contact with a left end portion of the long hole 152 due to elasticity of the buffer spring 144, and thus, the end rod 150 is also moved leftwards at the same time when the insulating rod 130 moves. Thereafter, when the movement of the insulating rod 130 is stopped, the end rod 150 continues to move, while compressing the buffer spring 144, and here, the movement of the end rod 150 continues until when the buffer spring 144 is completely compressed or until when the hinge shaft 140*a* reaches a right end portion of the long hole 152.

A cylinder 180 is connected to an outer circumferential portion of the end rod 150 and moved together with the end rod 150. During a breaking operation, a piston 190 is inserted into the cylinder 180 to apply pressure such that the charged arc-extinguishing gas is jetted toward the movable contact arm 160.

Figure 4:
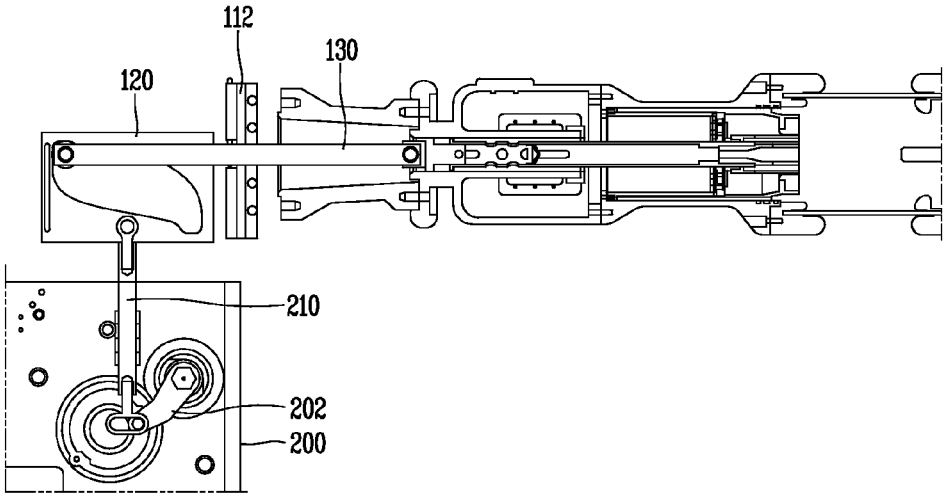
FIG. 4 is a cross-sectional view illustrating a state in which the movable contact arm is in a breaking position in the gas insulated switchgear according to the embodiment of the present invention.

FIG. 4 is a cross-sectional view illustrating a state in which the movable contact arm has moved to be in an opening position according to actuation of the actuator. Referring to FIG. 4 and FIG. 2, as the actuator 200 is actuated, the operating lever 202 is rotated in a counterclockwise direction. Accordingly, the connection rod 210 is also moved downwards from the position as shown in FIG. 2 to the position as shown in FIG. 4, making the cam 120 be moved downwards along the guide bar 112 as illustrated. Thus, the roller 132 in contact with the opening cam surface 124 is moved in order, starting from the first cam surface 124*a*, the third cam surface 124*c*, and the second cam surface 124*b*. Namely, the insulating rod 130 is moved leftwards along the opening cam surface 124.

As illustrated in FIG. 3, the first cam surface 124*a* is provided to have a great slope with respect to a movement direction of the movable contact arm. In actuality, the first cam surface 124*a* is configured as a continuous curve, and thus, an average slope of the first cam surface 124*a*, rather than a slope at a particular point, may be advantageous to specify a shape of the first cam surface 124*a*. In this sense, the average slope of the first cam surface 124*a* is greater than second and third average slopes. Thus, in a case in which the cam 120 is lowered by the same distance, a horizontal distance by which the movable contact arm has moved by the first cam surface is the shortest. Thus, since a section of the first cam surface 124*a* in which the same force is used is shortest, relative to the other cam surfaces 124*c* and 124*b*, acceleration of the movable contact arm by the first cam surface 124*a* is greater than those of the other two remaining cam surfaces 124*c* and 124*b*.

In the meantime, the second cam surface 124*b* has a slope approximate to a horizontal axis and accounts for a half or more of stroke of the movable contact arm. In addition, the recess 124*d* is provided at an end portion of the second cam surface 124*b* to prevent the moved movable contact arm from being moved out in the opposite direction due to impact. The third cam surface 124*c* serves to connect the first cam surface 124*a* and the second cam surface 124*b* and buffer a sharp difference in slopes between the first cam surface 124*a* and the second cam surface 124*b*.

As described above, at an initial stage of the breaking operation (that is opening operation), the movable contact arm is quickly moved in a short section of the first cam surface 124*a*, and slowly moved in a relatively long section by the second cam surface 124*b*. Thus, relatively large force is applied to the movable contact arm by the first cam surface 124*a* per a same horizontal distance of a stroke, the breaking operation may be quickly performed at the initial stage thereof. In addition, since the stroke section corresponding to the first cam surface 124*a* is short, a nearly constant actuating power is applied to the movable contact arm, and the actuating power has a value approximate to a maximum value, a movement speed of the movable contact arm can be maximized.

Meanwhile, since stroke by the second cam surface 124*b* accounts for majority of the overall stroke of the movable contact arm and it corresponds to a late stage of the breaking operation, a movement speed of the movable contact arm is low. In this case, however, since the movable contact arm has already been separated from the stationary contact arm 170 by the first cam surface 124*a*, the low speed does not greatly affect the breaking performance. Thus, a sufficient insulating distance between the movable contact arm and the stationary contact arm can be secured, while the movable contact arm is moved by the second cam surface 124*b*. The surface distance of third cam surface 124*c* is shorter than those of the first cam surface 124*a* and the second cam surface 124*b*, so the roller 132 is moved from the first cam surface 124*a* to the second cam surface 124*b* for a relatively short period of time. Thus, acceleration can be increased in the movement section by the second cam surface 124*b*.

Meanwhile, the closing cam surface 126 includes first and second cam surfaces 126*a* and 126*b*, and majority of sections of the closing cam surface 126 is the second cam surface 126*b*. A recess 126*c* is provided on an end portion of the second cam surface 126*b*.

Figure 5:
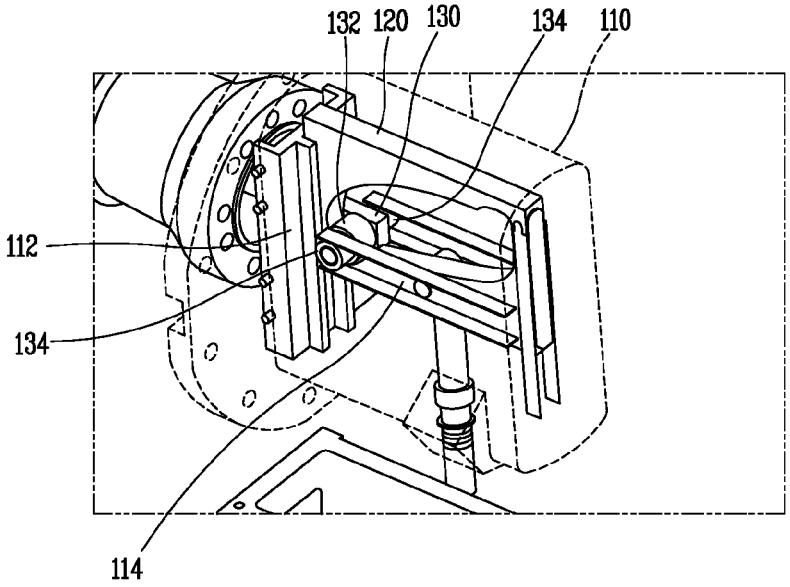
FIG. 5 is a perspective view illustrating a state in which a roller is insertedly positioned in a cam housing of the gas insulated switchgear according to the embodiment of the present invention.
Figure 6:
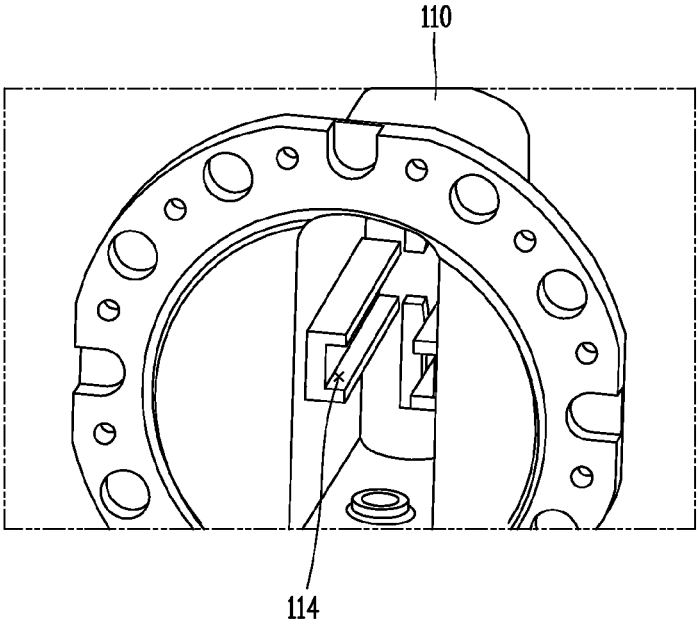
FIG. 6 is a front view illustrating the interior of the cam housing.

Referring to FIGS. 5 and 6, guide rollers 134 are installed on both sides of the roller 132 and inserted into a pair of guide rails 114 provided within the cam housing 110. The pair of guide rails 114 are provided to be parallel to a movement direction of the movable contact arm 160 to guide the insulating rod 130 to be moved, while maintaining a state of being parallel to the movable contact arm 160.

According to aspects of the present invention having the foregoing configuration, since a movement speed and a movement distance can be arbitrarily determined by the first and second cam surfaces having different shapes, a movement of the movable contact arm can be easily determined, increasing a degree of freedom of design. In addition, by increasing a movement speed and reducing a movement distance by the first cam surface, the movable contact arm can be rapidly separated from the stationary contact arm at an initial stage of a breaking operation.

In addition, the third cam surface is additionally provided between the first cam surface and the second cam surface, and a transition process from the first cam surface to the second cam surface is determined by adjusting the section of the third cam surface. Namely, when the third cam surface is short, a movement speed of the movable contact arm can be changed within a short time, and thus, acceleration of the movable contact arm can be increased.

Moreover, due to the presence of the first and second cam surfaces within the cam, cam coupling can be maintained between the movable contact arm and the cam in spite of a rapid movement.

The foregoing embodiments and advantages are merely exemplary and are not to be considered as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A gas insulated switchgear comprising:

an enclosure;

a stationary contact arm fixedly installed within the enclosure;

a movable contact arm movably installed within the enclosure such that it can be brought into contact with or separated from the stationary contact arm;

a cam moving the movable contact arm by reciprocating between a closing position and an opening position; and an actuator moving the cam, wherein the cam comprises an opening cam surface allowing the movable contact arm to move away from the stationary contact arm and a closing cam surface allowing the movable contact arm to move toward the stationary contact arm, wherein the opening cam surface comprises first and second cam surfaces, wherein movement acceleration of the movable contact arm by the first cam surface is greater than movement acceleration of the movable contact arm by the second cam surface when the actuator moves the cam to the opening position, and wherein a movement distance of the movable contact arm by the first cam surface is less than a movement distance of the movable contact arm by the second cam surface when the actuator moves the cam to the opening position.

2. The gas insulated switchgear of claim 1, wherein an average slope of the first cam surface with respect to an axial direction of the movable contact arm is set to be greater than an average slope of the second cam surface with respect to the axial direction of the movable contact arm.

3. The gas insulated switchgear of claim 2, wherein:

the opening cam surface further comprises a third cam surface located between the first cam surface and the second cam surface; and an average slope of the third cam surface with respect to the axial direction of the movable contact arm has a value between the average slopes of the first and second cam surfaces.

4. The gas insulated switchgear of claim 3, wherein an end portion of the second cam surface comprises a recess.

5. The gas insulated switchgear of claim 1, wherein:

the cam further comprises a space portion therein; and the first and second cam surfaces are located on an inner circumferential surface of the space portion.

6. The gas insulated switchgear of claim 5, further comprising a cam housing in which the cam is accommodated, the cam housing comprising a guide bar that guides movement of the cam.

7. The gas insulated switchgear of claim 6, wherein the cam housing further comprises guide rails that guide movement of the movable contact arm.

8. The gas insulated switchgear of claim 7, further comprising an insulating rod connected to the movable contact arm and the cam.

9. The gas insulated switchgear of claim 8, wherein at least a portion of the insulating rod is inserted between the guide rails.

10. The gas insulated switchgear of claim 8, further comprising a cam roller located at an end portion of the insulating rod, the cam roller in contact with the cam surface.

11. The gas insulated switchgear of claim 10, further comprising a rotational shaft supporting the cam roller, wherein both end portions of the rotational shaft are inserted between the guide rails.

12. The gas insulated switchgear of claim 5, wherein the actuator comprises:

an operating lever moving within a predetermined angle range; and a connection rod connecting the operating lever to the cam.

13. The gas insulated switchgear of claim 12, wherein:

the connection rod comprises a hole formed in an end portion; and the connection rod is hinge-coupled to the operating lever via the hole.

* * * * *